US007552756B2

(12) United States Patent
Riniker et al.

(10) Patent No.: US 7,552,756 B2
(45) Date of Patent: Jun. 30, 2009

(54) BRAZED ALUMINUM RADIATOR WITH PTO SECTION AND METHOD OF MAKING THE SAME

(75) Inventors: Martin J. Riniker, Franklin, WI (US); James R. Prochniak, Racine, WI (US); Craig D. Endres, Oak Creek, WI (US); John Lutz, Burlington, WI (US); Richard Bretl, Union Grove, WI (US); Gregg D. Olson, Racine, WI (US); David Mihalovich, Trenton, MO (US); Jarin Simpson, Spickard, MO (US)

(73) Assignee: Modine Manufacturing Company, Racine, WI (US)

( * ) Notice: Subject to any disclaimer, the term of this patent is extended or adjusted under 35 U.S.C. 154(b) by 159 days.

(21) Appl. No.: 11/483,789

(22) Filed: Jul. 10, 2006

(65) Prior Publication Data

US 2008/0006388 A1 Jan. 10, 2008

(51) Int. Cl.

| | |
|---|---|
| ***B60H 1/00*** | (2006.01) |
| ***F28F 7/00*** | (2006.01) |
| ***F28D 1/02*** | (2006.01) |
| ***F28F 9/02*** | (2006.01) |

(52) U.S. Cl. ..... 165/41; 165/173; 165/76; 165/152; 165/153

(58) Field of Classification Search ..... 165/173, 165/41, 76

See application file for complete search history.

(56) References Cited

U.S. PATENT DOCUMENTS

| | | | | |
|---|---|---|---|---|
| 1,109,384 | A * | 9/1914 | Alexander | 165/148 |
| 1,664,812 | A * | 4/1928 | Gargiulo et al. | 165/149 |
| 1,907,032 | A * | 5/1933 | Askin | 165/300 |
| 4,391,027 | A * | 7/1983 | Fleury | 29/890.046 |
| 6,543,525 | B2 * | 4/2003 | Kalbacher | 165/140 |
| 2006/0137855 | A1 * | 6/2006 | Daffron | 165/76 |

OTHER PUBLICATIONS

Engineering Drawings Nos. 3A054665, 3A054666, 3A52065D and AA19455D, Jul. 2006.

* cited by examiner

*Primary Examiner*—Cheryl J Tyler
*Assistant Examiner*—Brandon M Rosati
(74) *Attorney, Agent, or Firm*—Michael Best & Friedrich LLP

(57) ABSTRACT

A heat exchanger (10) is provided with a PTO section (12) passing through its core (14), with all of the components of the heat exchanger (10) being brazed together at the same time during assembly of the heat exchanger (10).

13 Claims, 5 Drawing Sheets

BRAZED ALUMINUM RADIATOR WITH PTO SECTION AND METHOD OF MAKING THE SAME

FIELD OF THE INVENTION

This invention relates to heat exchangers, and more particularly to heat exchangers having an opening passing through the core of the heat exchanger to allow other mechanical components to extend through the heat exchanger, such as a power take off ("PTO"), in vehicular applications.

BACKGROUND OF THE INVENTION

In vehicular applications, it is known to provide radiators with an opening passing through the core of the radiator to allow a power-take-off ("PTO") to extend from the engine through the core of the radiator to a location where it can drive an implement associated with the vehicle. These openings are sometimes referred to as PTO sections or pass-throughs. Such radiators are known to be manufactured by first brazing the tubes, fins, and oppositely spaced headers of the radiator together in one operation, and then assembling and welding the header and fluid connection components of the PTO section which allow the coolant from the tubes on one side of the PTO section to flow to the tubes on the other side of the PTO section. While such constructions may work well for their intended purpose, there is always room for improvement.

SUMMARY OF THE INVENTION

In accordance with one feature of the invention, a method is provided for manufacturing an air cooled heat exchanger. The method includes the steps of:

a) assembling a heat exchanger having a fin and tube core, a pair of primary headers connected to opposite ends of the core, an opening passing through the core, the opening bounded on a first side by a first header/tank assembly connected to an end of a first shortened section of the core opposite from one of the primary headers, on a second side opposite from the first side by a second header/tank assembly connected to an end of a second shortened section of the core opposite from the other of the primary headers, on a third side extending between the first and second sides by a portion of a third section of the core; and on a fourth side opposite from the third side by a portion of a forth section of the core; and b) brazing the fins and tubes of the core, the primary headers, and the secondary header/tank assemblies together in a single brazing operation.

In one feature, step a) includes:

a1) inserting ends of the tubes of the first section of the core into a header of the first header/tank assembly;

a2) inserting ends of the tubes of the second section of the core into a header of the second header/tank assembly;

a3) inserting ends of the tubes of the third section of the core into the primary headers;

a4) inserting ends of the tubes of the first section of the core into one of the primary headers;

a5) inserting ends of the tubes of the second section of the core into the other of the primary headers;

a6) inserting ends of the tubes of the fourth sections of the core into the primary headers; and a7) connecting respective tanks to the headers of the first and second header/tank assemblies, the tanks connected by at least one fluid conduit to transfer fluid from one tank to the other tank.

In a further feature, step a7) includes sliding at least one of the tanks relative to the at least one fluid conduit to allow assembly of the tanks to the headers of the first and second header/tank assemblies.

In another feature, step a4) includes abutting the header of the first header/tank assembly against a stops provided adjacent the third and forth sides; and step a5) includes abutting the header of the second header/tank assembly against stops provided adjacent the third and forth sides. As a further feature, the stops are provided on a pair of side plates, with one the side plates being provided as part of the third section and the other of the side plates being provides as part of the fourth section.

According to one feature, step a) includes providing the portion of the third section in the form of a side piece that extends between the primary headers, and providing the portion of the fourth section in the form of another side piece that extends between the primary headers.

As one feature, the tubes and fins of the core are provided in the form of a plurality of spaced parallel flattened tubes with corrugated fins extending between adjacent tubes.

In accordance with one feature of the invention, a method is provided for manufacturing an air cool heat exchanger. The method includes the steps of:

a) assembling a heat exchanger having a fin and tube core, a pair of primary headers connected to opposite ends of the core, an opening passing through the core, the opening bounded on a first side by a first header/tank assembly connected to an end of a first shortened section of the core opposite from one of the primary headers;

b) connecting the first header/tank assembly to a remainder of the heat exchanger with at least one fluid conduit extending from a tank of the first header/tank assembly; and c) brazing the fins and tubes of the core, the primary headers, and the first header/tank assembly, and the at least one conduit together in a single brazing operation.

In accordance with one feature of the invention, a heat exchanger includes:

a fin and tube core including a shortened core section located between two other core sections;

a pair of primary headers connected to opposite tube ends of the core; and an opening passing through the core, the opening bounded on two opposed sides by a pair of side pieces, each of the side pieces associated with one of the two other core sections, and bounded on another side by a first header/tank assembly connected to an end of the shortened core section opposite from one of the primary headers.

In accordance with one feature of the invention, a heat exchanger includes a fin and tube core including first, second, third, and fourth core sections; a pair of primary headers connected to opposite tube ends of the core; and an opening passing through the core. The opening is bounded on a first side by a first header/tank assembly connected to an end of the first section opposite from one of the primary headers, on a second side opposite from the first side by a second header/tank assembly connected to an end of the second section opposite from the other of the primary headers, on a third side extending between the first and second sides by a side piece of the third section; and on a fourth side opposite from the third side by a side piece of the forth section. The side pieces extend from one of the primary headers to the other primary header, with the first and second sections being located between the side pieces.

In one feature, each of the first and second header/tank assemblies includes a header receiving tube ends of the corresponding one of the first and second sections, and a tank connected to the tube header.

As a further feature, the heat exchanger includes at least one fluid conduit extending between the tanks of the first and second header/tank assemblies and having an end with a deformed mechanical connection to one of the tanks and an opposite end that is only connected to the other tank by a braze joint.

In another feature, each of the side pieces includes a pair of spaced stops, with one of the headers of the first and second header/tank assemblies abutted against one of the stops to locate the header with respect to the tube ends receive therein and the other of the headers of the first and second header/tank assemblies abutted against the other of the stops to locate the header with respect to the tube ends received therein.

In accordance with one feature of the invention, a heat exchanger includes a fin and tube core including first, second, third, and fourth core sections; a pair of primary headers connected to opposite tube ends of the core; an opening passing through the core. The opening is bounded on a first side by a first header/tank assembly connected to an end of the first section opposite from one of the primary headers, on a second side opposite from the first side by a second header/tank assembly connected to an end of the second section opposite from the other of the primary headers, on a third side extending between the first and second sides by a portion of the third section; and on a fourth side opposite from the third side by a portion of the forth section. Each of the first and second header/tank assemblies includes a header receiving tube ends of the corresponding one of the first and second sections, and a tank connected to the tube header. The heat exchanger further includes at least one fluid conduit extending between the tanks of the first and second header/tank assemblies and having an end with a deformed mechanical connection to one of the tanks and an opposite end that is only connected to the other tank by a braze joint.

As one feature, the portion of the third section is defined by a side piece extending between the primary headers, and the portion of the fourth section is defined by another side piece extending between the primary headers.

According to one feature, each of the side pieces includes a pair of spaced stops, with one of the headers of the first and second header/tank assemblies abutted against one of the stops to locate the header with respect to the tube ends receive therein and the other of the headers of the first and second header/tank assemblies abutted against the other of the stops to locate the header with respect to the tube ends received therein.

Other objects, features, and advantages of the invention will become apparent from a review of the entire specification, including the appended claims and drawings.

DETAILED DESCRIPTION OF THE PREFERRED EMBODIMENTS

Figure 2:
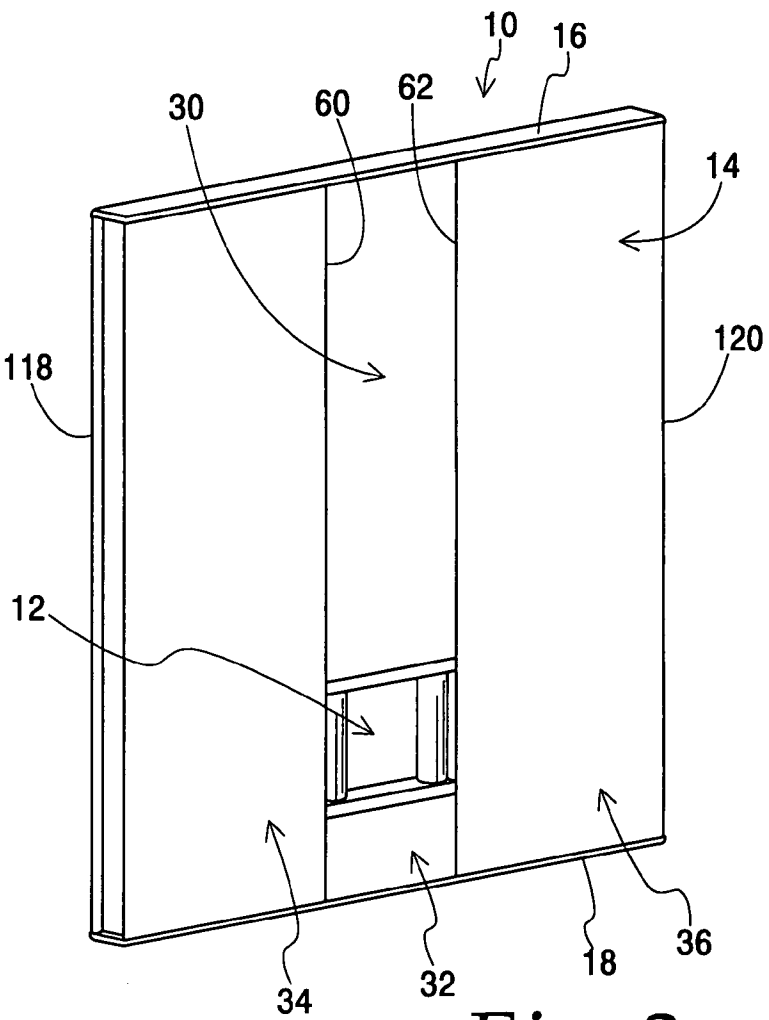
FIG. 2 is a front perspective view of the radiator of FIG. 1.
Figure 1:
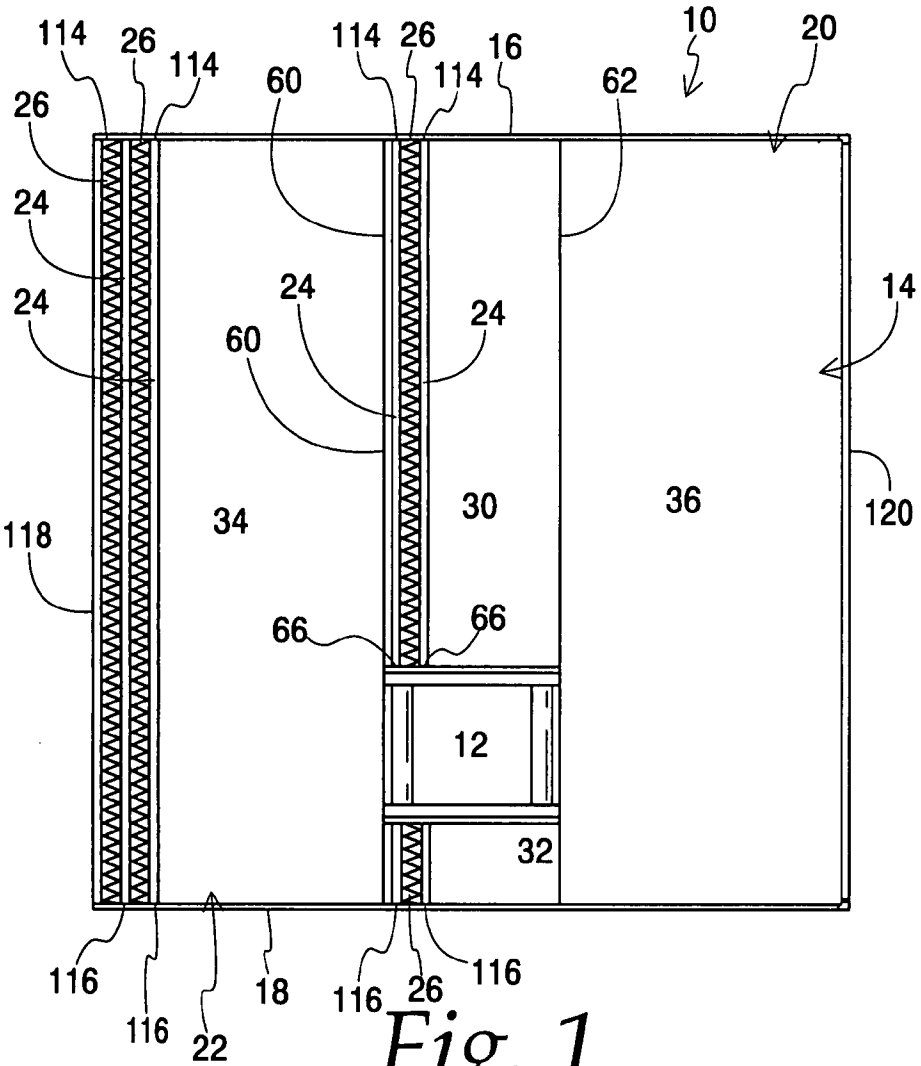
FIG. 1 is a front elevation of a radiator embodying the present invention.
Figure 4:
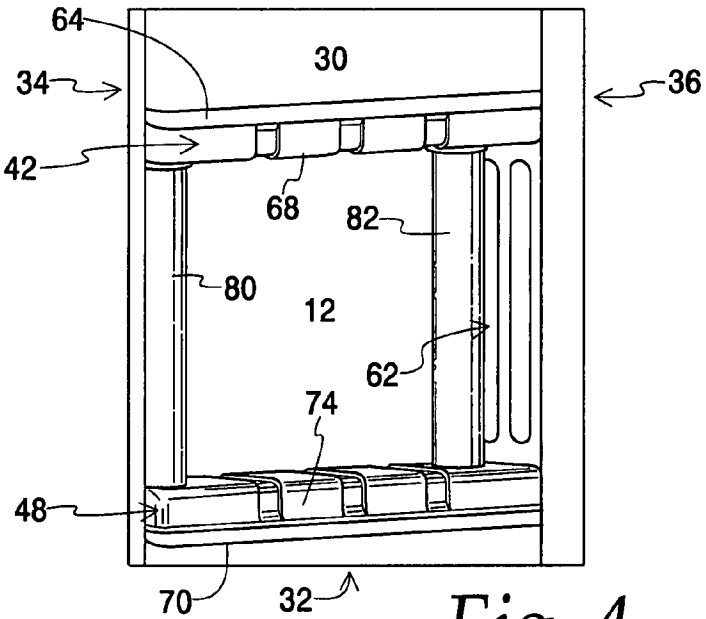
FIG. 4 is an enlarged front perspective view of the PTO section of FIG. 3.
Figure 12:
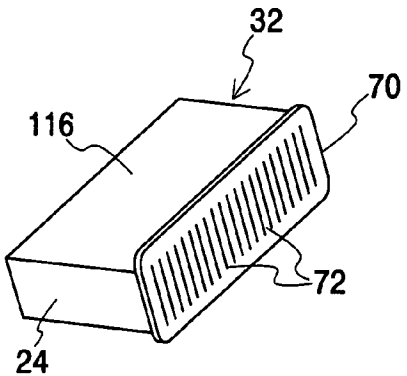
FIGS. 11 and 12 are perspective views of a pair of core subassemblies prior to assembly into the heat exchanger of FIG. 1.

With reference to FIGS. 1 and 2, a heat exchanger 10 is shown as an air cooled radiator for the coolant of an engine, and includes a so-called "PTO" section in the form of an opening 12 extending through a fin and tube core 14 of the heat exchanger 10. The heat exchanger 10 also includes a pair of primary tube plates or headers 16 and 18 connected to opposite ends 20 and 22 of the core 14. Although not shown, tanks of any suitable form can be connected to the headers 16 and 18 in order to distribute and/or collect the coolant from the core 14. It should be appreciated that while the heat exchanger 10 is described herein in connection with the illustrated radiator, the invention may find use with other types of heat exchangers and accordingly is not limited to radiators unless expressly recited in the claims.

While any suitable fin and/or tube constructions can be used, in a preferred form, the core 14 includes a plurality of spaced, parallel flattened tubes 24 (only six shown in FIG. 1 for purposes of illustration) with corrugated fins 26 (again only three partially shown for purposes of illustration) extending between adjacent pairs of the tubes 24 in a so-called parallel flow type construction. The core 14 is divided into a first core section 30, a second core section 32, a third core section 34, and a fourth core section 36, again with each of the sections 30, 32, 34 and 36 being formed from the flattened tubes 24 and corrugated fins 26.

Figure 3:
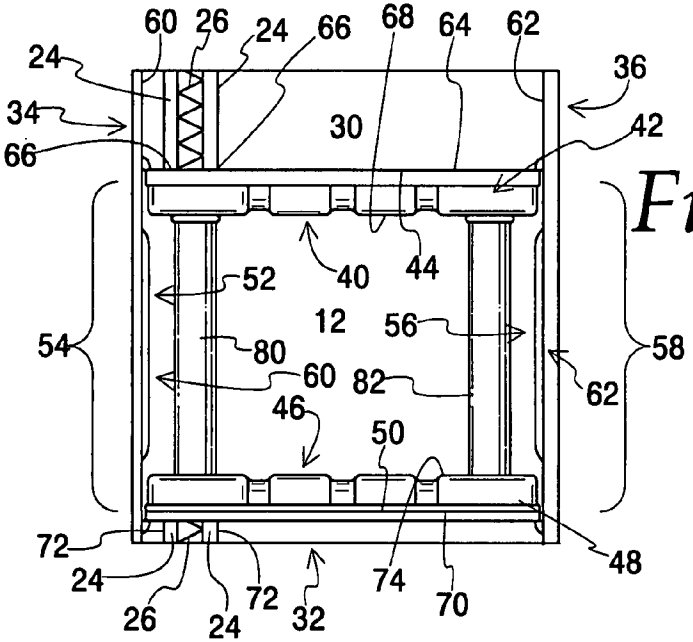
FIG. 3 is an enlarged front elevation of a PTO section of the heat exchanger of FIG. 1.
Figure 11:
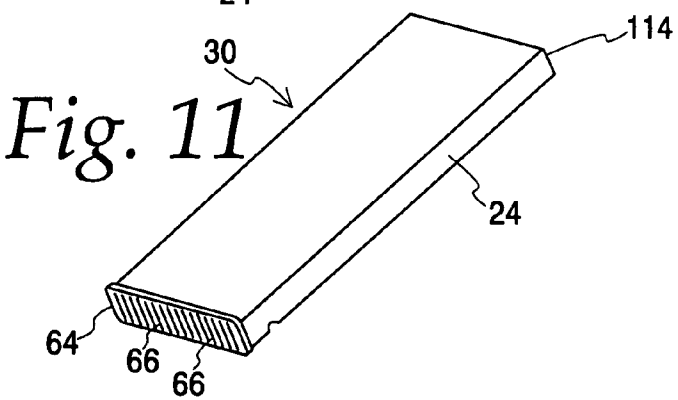
Figure 6:
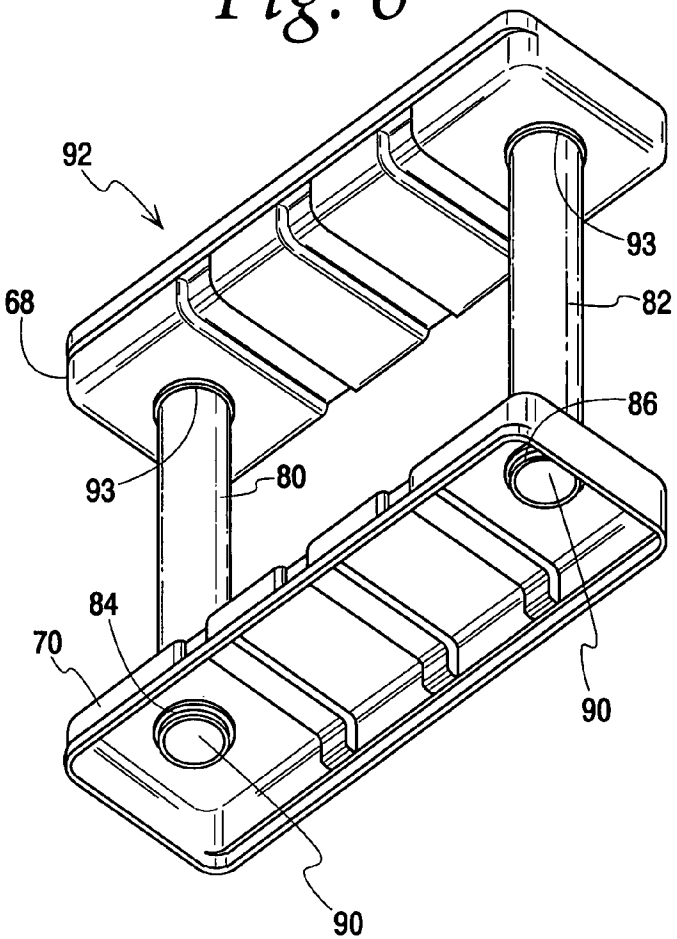
FIG. 6 is a perspective from below of the tank/transfer tube assembly of FIG. 5.
Figure 5:
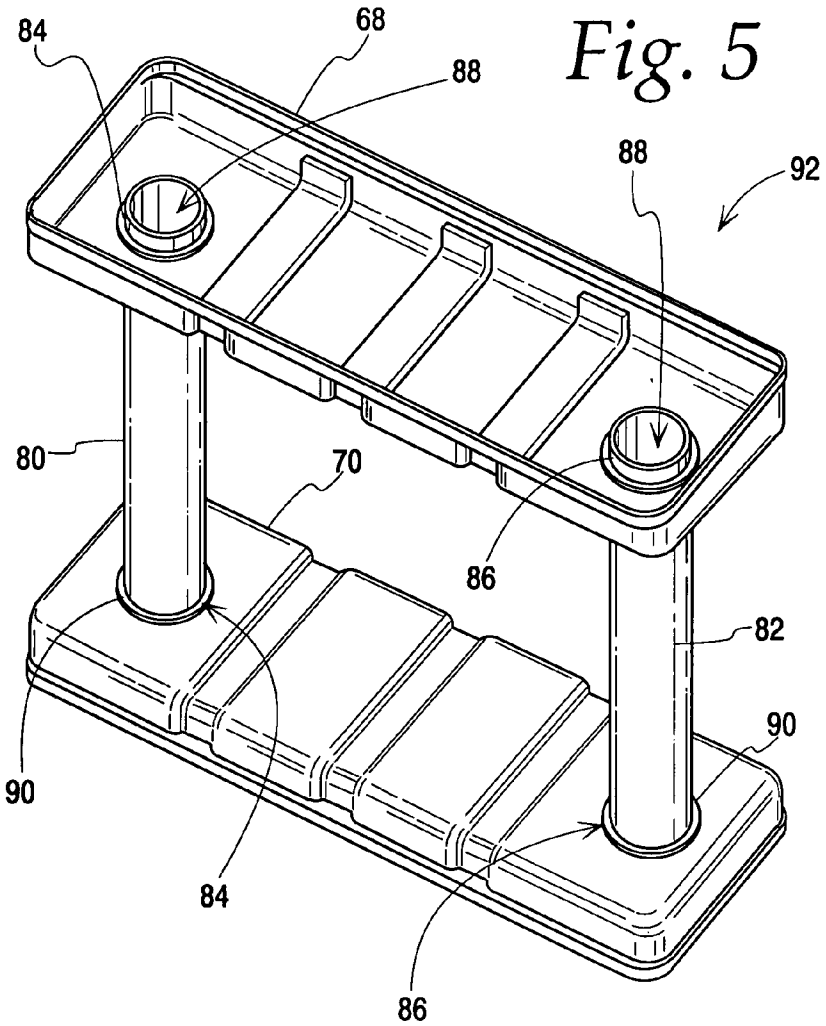
FIG. 5 is a perspective view from above of a tank/transfer tube assembly of the heat exchanger of FIG. 1.

As best seen in FIG. 3, the opening 12 is bounded on a first side 40 by a header/tank assembly 42 connected to an end 44 of the first section 30, on a second side 46 opposite from the first side 40 by another header/tank assembly 48 connected to an end 50 of the second section 32, on a third side 52 extending between the first and second sides 40 and 46 by a portion 54 of the third section 34, and on a fourth side 56 opposite from the third side 52 by a portion 58 of the fourth section 36. In this regard, the portion 54 is preferably defined by a side piece 60 of the third section 34 and the portion 58 is preferably defined by a side piece 62 of the fourth section 36, with each of the side pieces 60 and 62 extending from one of the headers 16 to the other header 18. The header/tank assembly 42 includes a tube plate or header 64 that receives tube ends 66 of the tubes 24 of the first section 30, and a tank 68 connected to the header 64 to collect and/or distribute coolant to and from the tubes 24 (only two shown in FIG. 3 for purposes of illustration) of the first section 30. Similarly, the second header/tank assembly 48 includes a tube plate or header 70 receiving the tube ends 72 of the tubes 24 (again, only two shown) of the second section 32 and a tank 74 connected to the header 70 to collect and/or distribute coolant to and from the tubes 24 of the section 32. A pair of fluid conduits in the form of cylindrical tubes 80 and 82 extend between the tanks 68 and 74 in order to direct coolant from one of the tanks 68,74 to the other of the tanks 68,74. In this regard, as best seen in FIGS. 5 and 6, each of the tanks 68,74 include a pair of spaced conduit receiving openings 84 and 86 that receive one of the opposite ends 88 and 90 of each of the tubes 80 and 82. In a highly preferred form, the tanks 68 and 74 and the tubes 80 and 82 are provided as a subassembly 92 during construction of the heat exchanger 10 with the ends 88 of each of the tubes 80 and 82 having a deformed mechanical connection to the tank 68 so as to fix the tanks 68 with respect to the tubes 80 and 82, and the other end 90 of each of the tubes 80 and 82 being allowed to slide freely through its respective opening 84,86 so as to allow the tanks 74 to slide freely relative to the tubes 80 and 82. Preferably, the deformed mechanical connection is provided by swedging the end 84 or by staking the end 84 and the corresponding opening 88 or 90, with a hose connection type bead 93 being provided on each of the tubes 80 and 82 to prevent movement of the tank 68 down the length of the tubes 80 and 82. It should be appreciated that the deformed mechanical connection could just as easily be provided between the tank 74 and the ends 90, with the tank 68 being allowed to slide freely relative to the tubes 80 and 82.

Figures 7, 8, 9, 10:
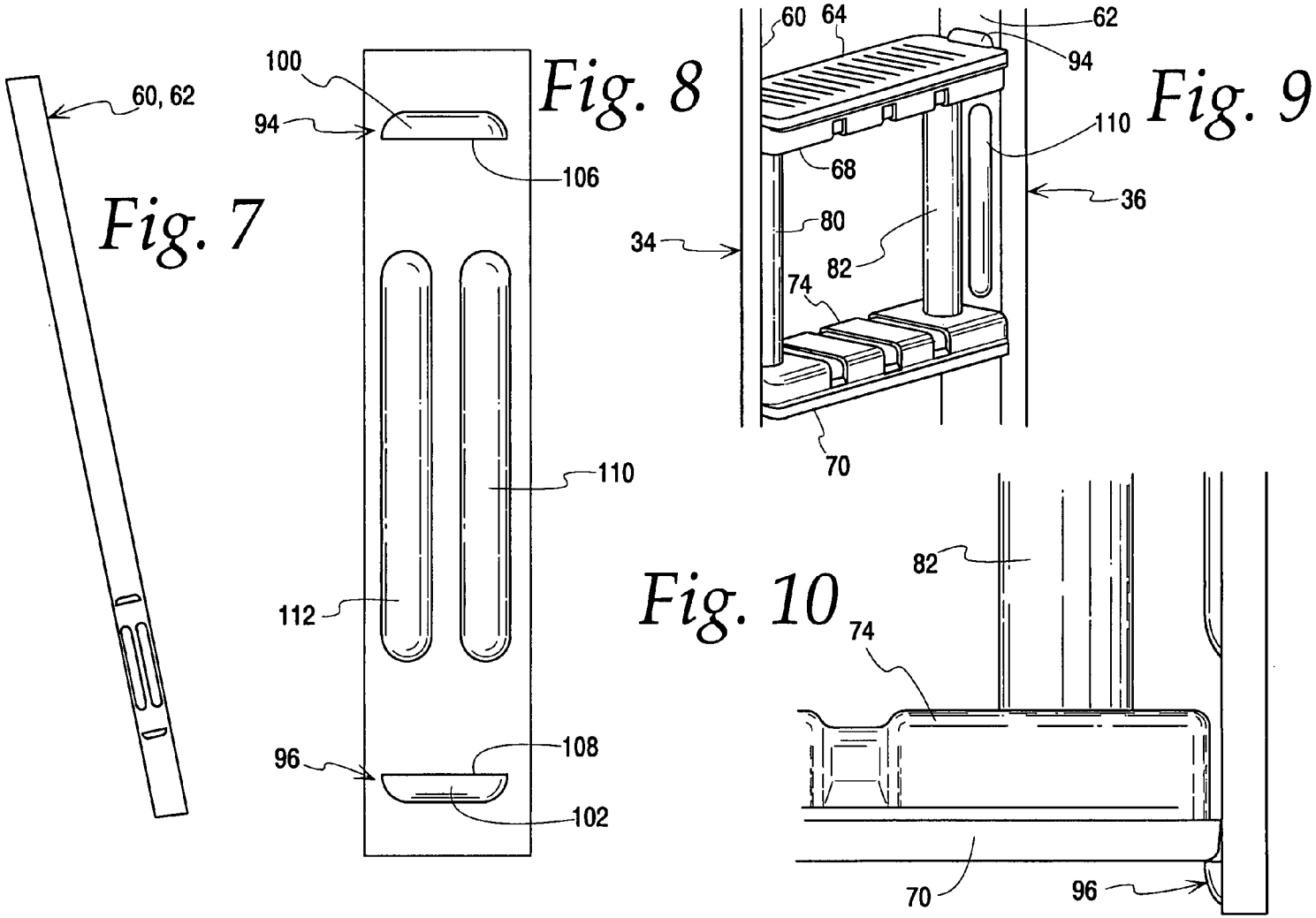
FIG. 7 is a perspective view of a internal side piece of the heat exchanger of FIG. 1.
FIG. 8 is an enlarged view of a portion of the side piece of FIG. 7.
FIG. 9 is a perspective view showing selected components of FIGS. 1-8 in an assembled state.
FIG. 10 is an enlarged front view of a portion of FIG. 9.

As best seen in FIGS. 7 and 8, each of the side pieces 60 and 62 are formed from a metal strip and include a pair of spaced stops 94 and 96, preferably provided in the form of an elongate, transverse embossed louvers 100 and 102 that are formed from the material of the side piece 60,62 and provide a stop surface 106 and 108 in the form an edge of the louver. As best seen in FIGS. 9 and 10, each of the headers 64,70 abuts one set of the stops 94 and 96 to locate the header 64,70 with respect to the tube ends 66 received therein. While not required, it is preferred that each of the side pieces 60 and 62 also include one or more elongate, embossed stiffening beads 110 and 112 in order to enhance the structural strength of the opening 12.

While any suitable material may be used, it is preferred that all of the components of the heat exchanger (with the possible exception of the unshown tanks for the primary headers 16 and 18) be made from aluminum, with braze cladding provided where appropriate. In this regard, it is also preferred that the tanks 68 and 74 be drawn aluminum tanks.

During assembly of the heat exchanger 10, the tubes 24 and fins 26 of the third or fourth core section 34 or 36 are assembled into the core 14, with the corresponding side piece 60 or 62 located on an inboard side of the corresponding section 34,36 and an additional channel shaped side piece 118 located on an outboard side of the core section 34, 36. The tubes 24 and fins 26 of each of the core sections 30 and 32 are assembled separately as subassemblies, and then assembled into the core 14. The tubes 24 and fins 26 of the other of the third or fourth core section 34 or 36 are next assembled into the core 14, with the corresponding side piece 60 or 62 located on an inboard side of the corresponding section 34,36 and an additional channel shaped side piece 120 located on an outboard side of the other core section 34, 36. Once the core stack is completed, a headering fixture will be used to insert the ends 114 and 116 of the tubes 24 into the respective headers 16 and 18, and the ends 66 and 72 into their respective headers 64 and 70, with the headers 64 and 70 abutting the stops 94 and 96. Next, the subassembly 92 is inserted into the core 14, with the tanks 74 slid along the tubes 80 and 82 towards the tank 68 so that the subassembly 92 can be inserted between the headers 64,70, of the core section 30,32. The tank 74 is then slid in an opposite direction so that the tanks 68 and 74 can be connected to their respective header 64 and 70. While clad brazing material may be used for all of the components of the heat exchanger 10, it may be desirable to add a brazing wire or collar at the interface between each of the tubes 80 and 82 and one or both of the openings 88 and 90 in each of the tanks 68 and 74. A brazing fixture is then provided to support the core both longitudinally and laterally while the fins 24 and tubes 26 of the core 14, the primary headers 16 and 18, the secondary header/tank assemblies 42 and 48, and the tubes 80 and 82 are placed in a braze oven and brazed at the same time to form suitable braze joints at all of the respective interfaces and provide a leak-free design.

Figure 13:
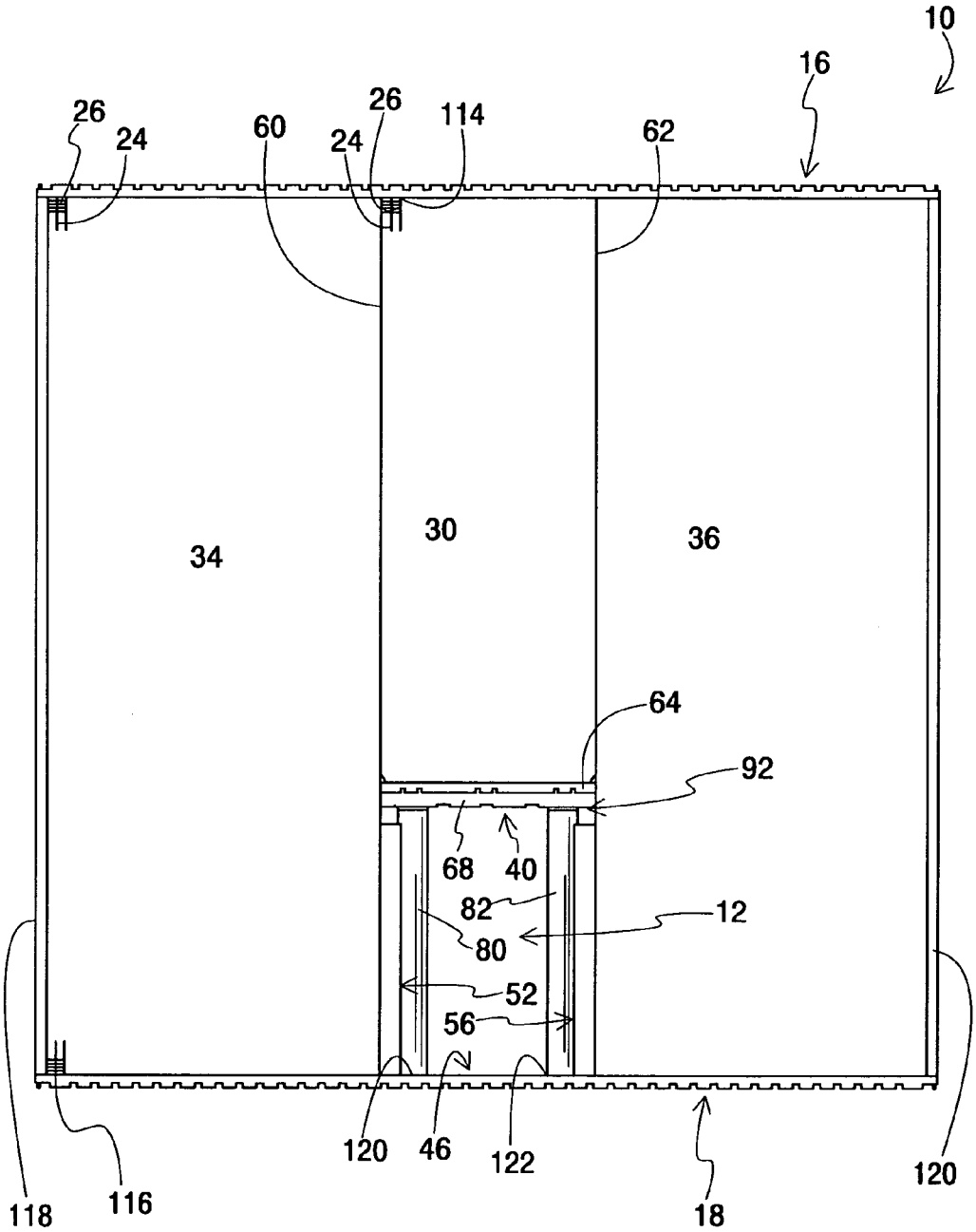
FIG. 13 is a front elevation of an alternate embodiment of a radiator embodying the present invention.

FIG. 13 shows an alternate embodiment of the heat exchanger 10 wherein the second core section 32 is eliminated and the opening 12 is bounded on the second side 46 by the primary header 18, rather than by the header/tank assembly 48 as in the embodiment of FIGS. 1-12. This embodiment can be assembled similar to the prior embodiment except that, obviously, there will be no assembly of the core section 32, and the tank 68 with the tubes 80 and 82 fixed thereto by the previously described deformed mechanical connection is assembled into the core 14, with the tubes 80 and 82 being allowed to slide freely through respective openings 120 and 122 in the header 18 so as to allow the tank 68 to be slid towards the header 118 for assembly of the core section 30 and associated header 64 into the core 14. After the core section 30 and the header 64 are assembled into the core 14, the tank 68 is slid together with the tubes 80 and 82 towards the header 64 to be connected therewith.

It should be appreciated that by brazing the components of the heat exchanger 10, including the components of the opening 12, the heat exchanger 10 can be manufactured in a simplified and more cost effective manner in comparison to constructions that require brazing and multiple weld steps. It should also be appreciated that the sliding tank structure of the subassembly 92 allows for the core sections 30, 32, 34 and 36 to be assembled in essentially conventional fashion, with the tanks 68,74 and tubes 80, 82 being added after. In this regard, it should be appreciated that by providing the stops 94 and 96, the headers 64 and 70 can be easily located with respect to the tubes 24 during assembly, which further allows the tanks 68 and 74 to be connected to the headers 64 and 70 while reacting the engagement force through the stops 94 and 96 to the side pieces 62 and 64.

The invention claimed is:

1. A heat exchanger comprising:

a fin and tube core including first, second, third, and fourth core sections and a plurality of tubes;

a pair of primary headers connected to opposite tube ends of the core; and an opening passing through the core, the opening bounded on a first side by a first header/tank assembly connected to an end of the first core section opposite from one of the primary headers, on a second side opposite from the first side by a second header/tank assembly connected to an end of the second section opposite from the other of the primary headers, on a third side extending between the first and second sides by a strip separate from said tubes of said fin and tube core located adjacent a first tube of the third core section; and on a fourth side opposite from the third side by a strip separate from said tubes of said fin and tube core located adjacent a first tube of the fourth core section, the strips extending from one of the primary headers to the other primary header, the first and second core sections being located between the strips.

2. The heat exchanger of claim 1 wherein each of the first and second header/tank assemblies comprises a tube header receiving tube ends of the corresponding one of the first and core second sections, and a tank connected to the tube header.

3. The heat exchanger of claim 2 further comprising at least one fluid conduit extending between the tanks of the first and second header/tank assemblies and having an end with a deformed mechanical connection to one of the tanks and an opposite end that is only connected to the other tank by a braze joint.

4. The heat exchanger of claim 2 wherein each of the strips includes a pair of spaced stops, with one of the headers of the first and second header/tank assemblies abutted against one of the stops to locate the header with respect to the tube ends received therein and the other of the headers of the first and second header/tank assemblies abutted against the other of the stops to locate the header with respect to the tube ends received therein.

5. The heat exchanger of claim 1 wherein the tubes and fins of the core comprise a plurality of spaced parallel flattened tubes with corrugated fins extending between adjacent tubes.

6. A heat exchanger comprising:

a fin and tube core including first, second, third, and fourth core sections and a plurality of tubes;

a pair of primary headers connected to opposite tube ends of the core;

an opening passing through the core, the opening bounded on a first side by a first header/tank assembly connected to an end of the first section opposite from one of the primary headers, on a second side opposite from the first side by a second header/tank assembly connected to an end of the second section opposite from the other of the primary headers, on a third side extending between the first and second sides by a portion of the third section; and on a fourth side opposite from the third side by a portion of the forth section, each of the first and second header/tank assemblies comprising a header receiving tube ends of the corresponding one of the first and second sections, and a tank connected to the tube header; and at least one fluid conduit extending between the tanks of the first and second header/tank assemblies and having an end with a deformed mechanical connection to one of the tanks and an opposite end that is only connected to the other tank by a braze joint;

wherein the portion of the third section is defined and bounded by a strip separate from said tubes of said fin and tube core extending between the primary headers and adjacent a first tube of the third section, and the portion of the fourth section is defined and bounded by another strip separate from said tubes of said fin and tube core extending between the primary headers and adjacent a first tube of the fourth section.

7. The heat exchanger of claim 6 wherein each of the strips includes a pair of spaced stops, with one of the headers of the first and second header/tank assemblies abutted against one of the stops to locate the header with respect to the tube ends receive therein and the other of the headers of the first and second header/tank assemblies abutted against the other of the stops to locate the header with respect to the tube ends received therein.

8. The heat exchanger of claim 6 wherein the tubes and fins of the core comprise a plurality of spaced parallel flattened tubes with corrugated fins extending between adjacent tubes.

9. A heat exchanger comprising:

a fin and tube core including a shortened core section located between two other core sections and a plurality of tubes;

a pair of primary headers connected to opposite tube ends of the core; and an opening passing through the core, the opening bounded on two opposed sides by a pair of strips separate from said tubes of said fin and tube core, each of the strips associated with a first tube of one of the two other core sections, and bounded on another side by a first header/tank assembly connected to an end of the shortened core section opposite from one of the primary headers.

10. The heat exchanger of claim 9 wherein the first header/tank assembly comprises a header receiving tube ends of the shortened core section and a tank connected to the header.

11. The heat exchanger of claim 10 further comprising at least one fluid conduit extending from the first header/tank assembly to a remainder of the heat exchanger.

12. The heat exchanger of claim 9 wherein each of the strips includes at least one stop, with the header of the first header/tank assembly abutted against the stops to locate the header with respect to the tube ends received therein.

13. The heat exchanger of claim 9 wherein the opening is bounded on yet another side by a second header/tank assembly connected to an end of another shortened core section opposite from the other of the primary headers.

* * * * *